US011035574B2

(12) United States Patent
Delgado et al.

(10) Patent No.: US 11,035,574 B2
(45) Date of Patent: Jun. 15, 2021

(54) COOKTOP HAVING ELECTRICALLY CONTROLLED GAS FLOW

(71) Applicants: BSH Home Appliances Corporation, Irvine, CA (US); BSH Hausgeräte GmbH, Munich (DE)

(72) Inventors: Humberto Delgado, Franklin, TN (US); Brian Silva, Knoxville, TN (US); Tyson White, Anderson, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 164 days.

(21) Appl. No.: 16/416,316

(22) Filed: May 20, 2019

(65) Prior Publication Data

US 2020/0370754 A1 Nov. 26, 2020

(51) Int. Cl.

| | |
|---|---|
| ***F24C 3/12*** | (2006.01) |
| ***G05G 1/08*** | (2006.01) |
| *F24C 3/02* | (2006.01) |

(52) U.S. Cl.

CPC ..... *F24C 3/126* (2013.01); *F24C 3/124* (2013.01); *G05G 1/08* (2013.01); *F23N 2235/14* (2020.01); *F24C 3/027* (2013.01)

(58) Field of Classification Search

CPC ..... F24C 3/126; F16K 31/0675; F16K 31/46; F16K 31/62; F16K 31/06; F16K 37/0025; H01F 7/1805; F23N 2233/08; F23N 1/02; F23N 2237/10; F23N 2241/14; F23N 2223/08; F23N 2227/02; F23N 2227/42; F23N 5/203; F23N 1/022; F23N 2225/04; F23N 2225/12; F23N 2227/04; F23N 2227/06; F23N 2227/28; F23N 2229/00; F23N 2233/06; F23N 2233/10; F23N 2235/14; F23N 2235/24; F23N 2239/06; F23N 5/08; F23N 5/082; F23N 5/242; F23N 2225/08; F23N 2231/18; F23N 2231/26; F23N 2235/18; F23N 2235/30; F23N 5/20; F23N 2223/26; F23N 2227/10; F23N 2227/22; F23N 2233/04; F23N 3/08; F23N 5/065; F23N 5/10; F23N 1/002;

(Continued)

(56) References Cited

U.S. PATENT DOCUMENTS

| | | | | |
|---|---|---|---|---|
| 4,645,176 A * | 2/1987 | Ogawa | F16K 31/06 251/129.08 |
| 2019/0242583 A1* | 8/2019 | Paller | F23N 1/002 |

FOREIGN PATENT DOCUMENTS

| | | |
|---|---|---|
| CN | 203731501 U | 7/2014 |
| CN | 105042646 A | 11/2015 |

(Continued)

*Primary Examiner* — Jason Lau

(74) *Attorney, Agent, or Firm* — Michael E. Tschupp; Andre Pallapies; Brandon G. Braun

(57) ABSTRACT

Gas cooktops disclosed herein may include a proportional solenoid valve controlling gas flow to a gas burner, where the proportional solenoid valve has a continuously variable range of positions. A user interface (UI) element associated with the proportional solenoid valve may be utilized to control a linear voltage regulator having a continuously variable output voltage. The output voltage of the linear voltage regulator is coupled to a solenoid of the proportional solenoid valve, such that the gas flow to the gas burner has a linear relationship with the output voltage of the linear voltage regulator.

20 Claims, 5 Drawing Sheets

(58) Field of Classification Search
CPC ..... F23N 2223/38; F23N 2235/16; F23N 2237/02; F23N 2241/11; F23N 5/265; F23K 5/04; F23K 5/147; B05B 12/04; B05B 12/06; B05B 12/18; B05B 7/08; B05B 7/24; F02M 35/10; F02M 35/10321; F02M 65/002; F02M 25/10; F02M 25/12; F23D 14/28; F23D 14/465; F27D 2021/0071; F27D 21/00; F27D 25/003
See application file for complete search history.

(56) References Cited

FOREIGN PATENT DOCUMENTS

| | | | |
|---|---|---|---|
| CN | 105202590 | A | 12/2015 |
| CN | 105987406 | A | 10/2016 |

* cited by examiner

COOKTOP HAVING ELECTRICALLY CONTROLLED GAS FLOW

FIELD

This disclosure relates to systems and methods for gas-burning appliances. More specifically, the disclosed embodiments relate to control systems for gas burners.

INTRODUCTION

Gas cooktops and burners are typically controlled by one or more manual knobs that are mechanically coupled to respective throttle valves. Some manufacturers have incorporated step valve systems, which include multiple valves of varying flow capabilities arranged in a manifold. Flow through this manifold is then controlled in varying permutations by opening and/or closing corresponding solenoid valves, e.g., using a stepwise rotary switch. In either the mechanical or the step-valve solution, the change in actual gas flow is nonlinear with respect to the controls being applied. A better solution is needed to provide more predictably controllable and precise gas flows for high-quality gas-burning appliances.

SUMMARY

The present disclosure provides systems, apparatuses, and methods relating to gas cooktops having control systems configured to provide repeatably linear flow characteristics with respect to a user input. In some embodiments, a gas cooktop may include: a gas burner; a throttle valve controlling a gas flow to the gas burner from a supply of combustible gas, wherein the throttle valve comprises a proportional solenoid valve having a continuously variable position; and a linear voltage regulator having a continuously variable output voltage configured to be controllable by a user interface (UI) element; wherein the output voltage of the linear voltage regulator is coupled to a solenoid of the throttle valve and configured to control the continuously variable position of the throttle valve, such that the gas flow to the gas burner has a linear relationship with the output voltage of the linear voltage regulator.

In some embodiments, a gas cooktop may include: a gas burner; a proportional solenoid valve controlling a gas flow to the gas burner from a supply of combustible gas, wherein the proportional solenoid valve has a continuously variable range of positions; a user interface (UI) element associated with the proportional solenoid valve; and a linear voltage regulator having a continuously variable output voltage configured to be controllable by the UI element; wherein the output voltage of the linear voltage regulator is coupled to a solenoid of the proportional solenoid valve, such that the gas flow to the gas burner has a linear relationship with the output voltage of the linear voltage regulator.

In some embodiments, a method for controlling a burner of a gas cooktop may include: controlling the output voltage of a linear voltage regulator using a continuously variable output from a user interface (UI) element; and controlling a gas flow to a gas burner from a supply of combustible gas by using the output of the linear voltage regulator to continuously vary a throttling position of a proportional solenoid valve within a range of positions; wherein the gas flow to the gas burner has a linear relationship with the output voltage of the linear voltage regulator.

Features, functions, and advantages may be achieved independently in various embodiments of the present disclosure, or may be combined in yet other embodiments, further details of which can be seen with reference to the following description and drawings.

DETAILED DESCRIPTION

Figure 1:
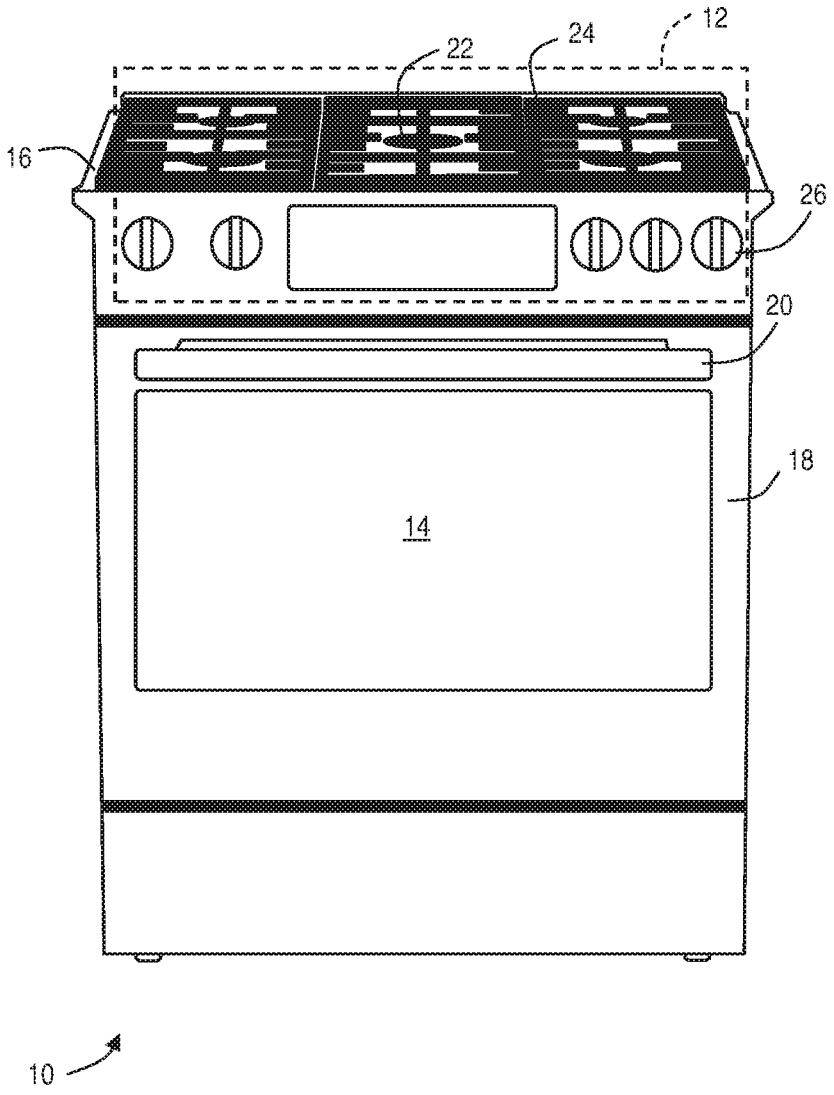
FIG. 1 is a perspective view of an illustrative gas range suitable for use with aspects of the present disclosure.

Various aspects and examples of control systems for controlling gas flows in a gas burner cooktop, as well as related methods, are described below and illustrated in the associated drawings. Unless otherwise specified, a control system in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through D, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Coupled" means connected, either permanently or releasably, whether directly or indirectly through intervening components.

"Processing logic" means any suitable device(s) or hardware configured to process data by performing one or more logical and/or arithmetic operations (e.g., executing coded instructions). For example, processing logic may include one or more processors (e.g., central processing units (CPUs) and/or graphics processing units (GPUs)), microprocessors, clusters of processing cores, FPGAs (field-programmable gate arrays), artificial intelligence (AI) accelerators, digital signal processors (DSPs), and/or any other suitable combination of logic hardware.

Overview

In general, a control system for gas cooktops in accordance with the present teachings may include a proportional solenoid valve providing combustible (e.g., natural or propane) gas to a gas burner for use in cooking, e.g., on a multiple-burner stove. The proportional valve is controlled by a variable electrical signal provided by a linear voltage regulator, which in turn is controlled by a user interface element. Stroking of the valve spool can have a positioning granularity that is substantially infinite, thus providing infinitely adjustable gas flow. The proportional valve provides a linear change in output gas flow, i.e., proportional to the change in the input signal.

Aspects of the control systems described herein may be embodied as a computer method, computer system, or computer program product. Accordingly, aspects of the control system may take the form of an entirely hardware embodiment, an entirely software embodiment (including firmware, resident software, micro-code, and the like), or an embodiment combining software and hardware aspects, all of which may generally be referred to herein as a "circuit," "module," or "system." Furthermore, aspects of the control system may take the form of a computer program product embodied in a computer-readable medium (or media) having computer-readable program code/instructions embodied thereon.

Any combination of computer-readable media may be utilized. Computer-readable media can be a computer-readable signal medium and/or a computer-readable storage medium. A computer-readable storage medium may include an electronic, magnetic, optical, electromagnetic, infrared, and/or semiconductor system, apparatus, or device, or any suitable combination of these. More specific examples of a computer-readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, and/or any suitable combination of these and/or the like. In the context of this disclosure, a computer-readable storage medium may include any suitable non-transitory, tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, and/or any suitable combination thereof. A computer-readable signal medium may include any computer-readable medium that is not a computer-readable storage medium and that is capable of communicating, propagating, or transporting a program for use by or in connection with an instruction execution system, apparatus, or device.

Program code embodied on a computer-readable medium may be transmitted using any appropriate medium, including but not limited to wireless, wireline, optical fiber cable, RF, and/or the like, and/or any suitable combination of these.

Computer program code for carrying out operations for aspects of the control systems disclosed herein may be written in one or any combination of programming languages, including an object-oriented programming language (such as Java, C++), conventional procedural programming languages (such as C), and functional programming languages (such as Haskell). Mobile apps may be developed using any suitable language, including those previously mentioned, as well as Objective-C, Swift, C#, HTML5, and the like. The program code may execute entirely on a user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), and/or the connection may be made to an external computer (for example, through the Internet using an Internet Service Provider).

Aspects of the control system may be described below with reference to flowchart illustrations and/or block diagrams of methods, apparatuses, systems, and/or computer program products. Each block and/or combination of blocks in a flowchart and/or block diagram may be implemented by computer program instructions. The computer program instructions may be stored in memory to be retrieved or otherwise provided to processing logic (e.g., a processor of a general purpose computer, special purpose computer, field programmable gate array (FPGA), or other programmable data processing apparatus) to produce a machine, such that the (e.g., machine-readable) instructions, which execute via the processing logic, create means for implementing the functions/acts specified in the flowchart and/or block diagram block(s).

Additionally or alternatively, these computer program instructions may be stored in a computer-readable medium that can direct processing logic and/or any other suitable device to function in a particular manner, such that the instructions stored in the computer-readable medium produce an article of manufacture including instructions which implement the function/act specified in the flowchart and/or block diagram block(s).

The computer program instructions can also be loaded onto processing logic and/or any other suitable device to cause a series of operational steps to be performed on the device to produce a computer-implemented process such that the executed instructions provide processes for implementing the functions/acts specified in the flowchart and/or block diagram block(s).

Any flowchart and/or block diagram in the drawings is intended to illustrate the architecture, functionality, and/or operation of possible implementations of systems, methods, and computer program products according to aspects of the control system. In this regard, each block may represent a module, segment, or portion of code, which comprises one or more executable instructions for implementing the specified logical function(s). In some implementations, the functions noted in the block may occur out of the order noted in the drawings. For example, two blocks shown in succession may, in fact, be executed substantially concurrently, or the blocks may sometimes be executed in the reverse order, depending upon the functionality involved. Each block and/or combination of blocks may be implemented by special purpose hardware-based systems (or combinations of special purpose hardware and computer instructions) that perform the specified functions or acts.

Examples, Components, and Alternatives

The following sections describe selected aspects of exemplary control systems for gas cooktops as well as related systems and/or methods. The examples in these sections are intended for illustration and should not be interpreted as limiting the scope of the present disclosure. Each section may include one or more distinct embodiments or examples, and/or contextual or related information, function, and/or structure.

A. First Illustrative Control System

Figure 2:
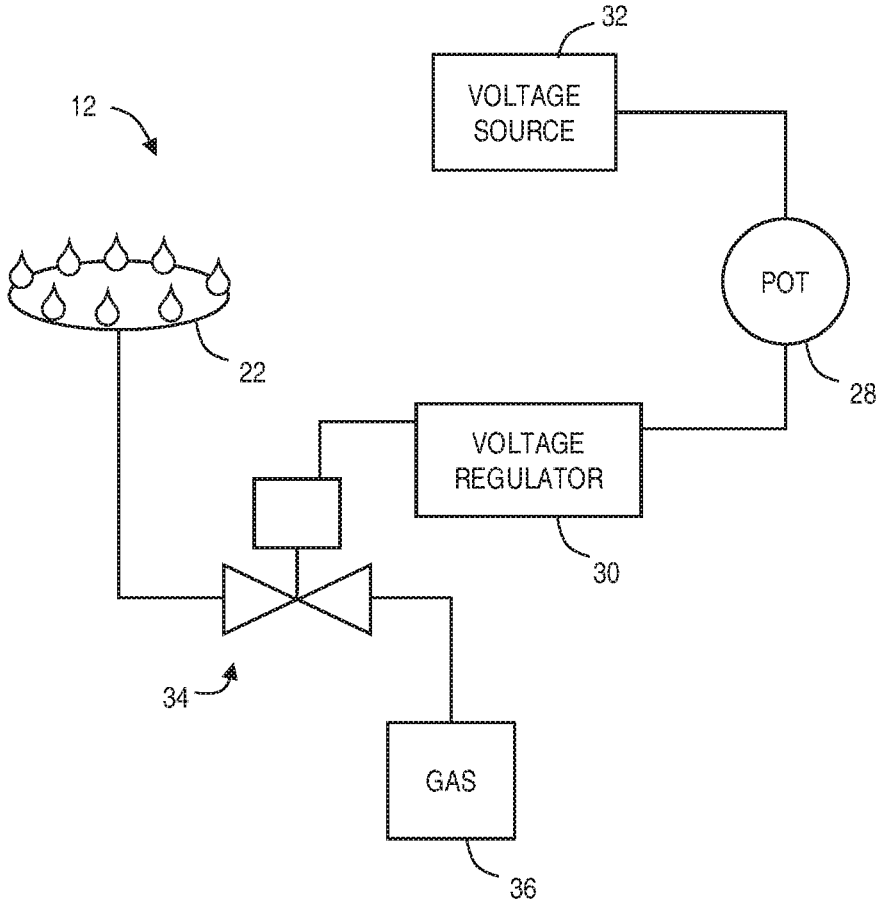
FIG. 2 is a schematic diagram of a first illustrative control system for a gas burner, in accordance with aspects of the present disclosure.

As shown in FIGS. 1-2, this section describes an illustrative gas range 10 having a burner control system 12 configured to provide linear gas flow distribution. Control system 12 is an example of the control systems described in the Overview above.

Gas range 10 may include an oven 14 and a cooktop 16. Oven 14 has a door 18, pivotably operable by a manual handle 20 to provide access to an oven cavity within. Cooktop 16 includes one or more burners 22, above which are mounted grates 24 to support cookware and other devices that may be placed thereon for cooking and heating purposes. Gas flow to each burner 22 is controlled by a user interface (UI) element 26. In this example, the user interface elements comprise continuously rotatable knobs (as opposed to discrete-position knobs). However, any suitable user interface element configured to provide continuously variable control of an associated potentiometer 28 may be utilized, such as lever, dial, or slider.

Potentiometer 28 is coupled to UI element 26, such that changing the position of the UI element also changes the setting (i.e., resistance) of the potentiometer. Output voltage of a linear voltage regulator 30 is controlled by potentiometer 28, with the voltage being supplied by a voltage supply 32 (e.g., a 12V voltage supply). The output of voltage regulator 30 is therefore linear and is coupled to a proportional solenoid valve 34. Voltage regulator 30 may include any suitable linear voltage regulator configured to be powered by a voltage supply and have its voltage output depend on a variable resistance input. In some examples, an LM317 adjustable positive linear voltage regulator may be utilized. However, any suitable linear voltage regulator may be used. Proportional solenoid valve 34 is piped to a combustible gas supply 36, for example a building natural gas line or a propane tank, and provides a variable gas flow to one burner of burners 22 of cooktop 16. Proportional solenoid valve 34 may include any suitable proportional valve the position (and therefore gas flow) of which is controllable by applying a varying voltage to a corresponding solenoid.

The position of the valve is continuously variable between closed and open positions. For example, the valve may be 50% open or 25% open, depending on the voltage supplied by voltage regulator 30. Moreover, gas flow through the valve is predictably throttled by the proportional valve, and therefore may be continuously varied based on valve position. Accordingly, the proportional valve is configured such that varying the voltage linearly results in a behavior of the valve position which results in linear behavior of the gas flow to burner 22. See FIG. 5. Although a single potentiometer, voltage regulator, valve, and burner are shown in FIG. 2, any suitable number of these components may be provided.

B. Second Illustrative Control System

Figure 3:
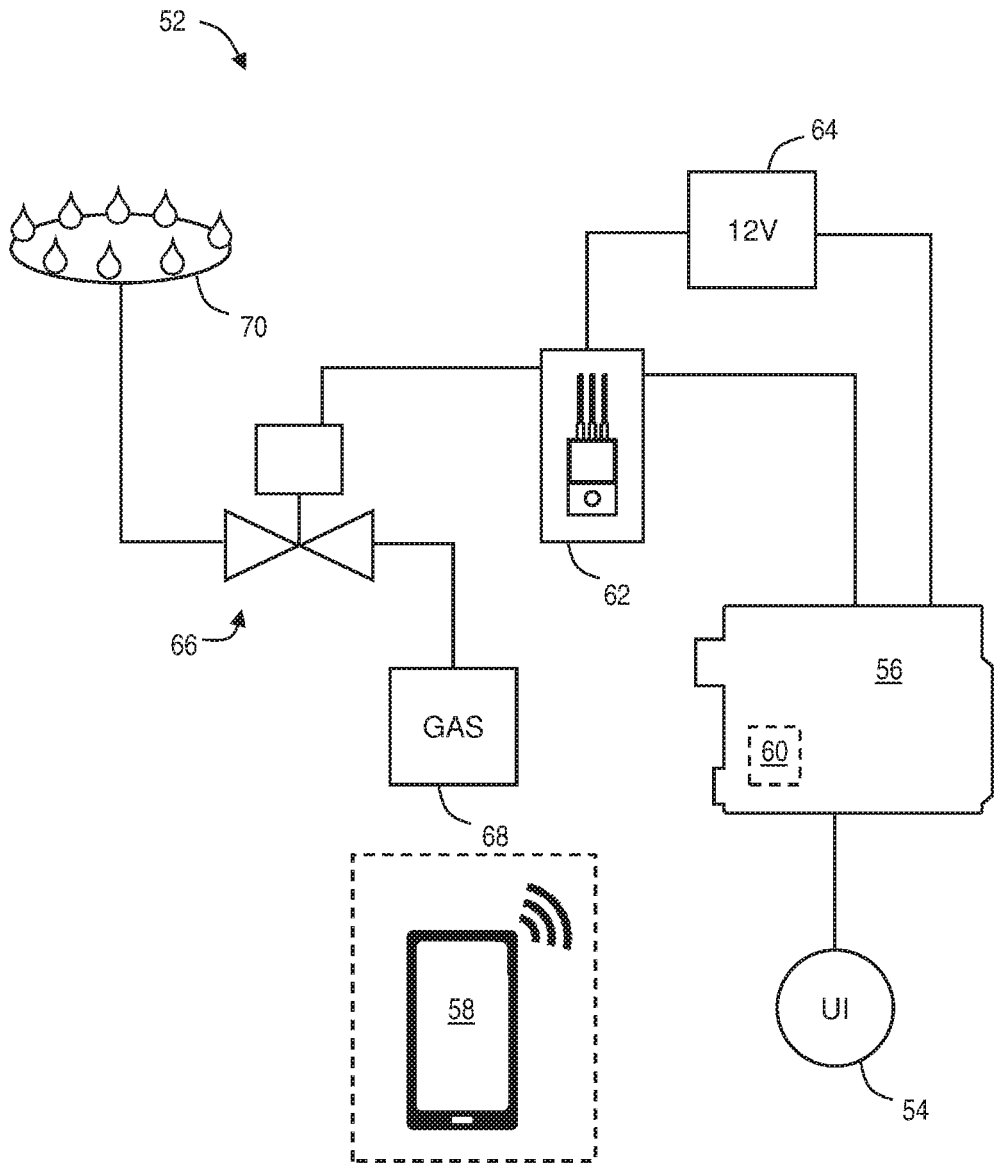
FIG. 3 is a schematic diagram of a second illustrative control system for a gas burner, in accordance with aspects of the present disclosure.

As shown in FIG. 3, this section describes another illustrative burner control system 52 configured to provide linear gas flow distribution. Control system 52 is another example of the control systems described in the Overview above. Control system 52 may be incorporated into any suitable gas range, substantially similar to gas range 10.

Control system 52 includes a user interface (UI) element 54, which may include any suitable human machine interface (HMI) configured to provide a continuously- or substantially continuously-variable output usable by an electronic controller 56. UI element 54 may, for example, include one or more manipulable controls such as a lever, dial, switch, slider, pushbutton, keypad, and/or knob, any of which may be implemented electronically, mechanically, and/or virtually (such as via a graphical user interface (GUI) on a screen or other display). In some examples, UI element 54 may include a touch control (e.g., a capacitive touch control, such as those having a wheel or slider interface).

In some examples, a digital input is provided to controller 56 remotely, e.g., wirelessly, by a wireless UI element 58. Wireless UI element 58 may include any suitable human machine interface configured to provide a continuously or substantially continuously variable output signal in a wireless fashion (e.g., over a Bluetooth® wireless or WiFi connection) to a receiver 60 coupled to electronic controller 56. Wireless UI element 58 may include, for example, a voice interface capable of speech recognition, through which the operator may provide voice commands to the controller. In some examples, wireless UI element 58 may include the interface of a software application (AKA an "app") running on a portable or wearable computing device, such as an article of clothing or a wrist- or head-mounted interface, or a mobile digital device (e.g., a smartphone or tablet).

Based on the signal from UI element 54 and/or wireless UI element 58, processing logic of controller 56 is configured to provide a continuously variable output signal (e.g., a controller output voltage). The voltage output of a linear voltage regulator 62 is controlled by the controller output signal, with the regulator's input voltage being supplied by a voltage supply 64 (e.g., a 12V voltage supply). The output of voltage regulator 62 is therefore linear and is coupled to a proportional solenoid valve 66. Voltage regulator 62 may include any suitable linear voltage regulator configured to be powered by a voltage supply and have its voltage output depend on a variable voltage input. In some examples, a power MOSFET (metal-oxide-semiconductor field-effect transistor) may be utilized. However, any suitable linear voltage regulator may be used.

As in control system 12, proportional solenoid valve 66 is piped to a combustible gas supply 68, for example a building natural gas line or a propane tank, and provides a variable gas flow to a burner 70 of a gas cooktop. Proportional solenoid valve 66 may include any suitable proportional valve the position (and therefore gas flow) of which is controllable by applying a varying voltage to a corresponding solenoid.

The position of the valve is continuously variable between closed and open positions. For example, the valve may be 50% open or 25% open, depending on the voltage supplied by voltage regulator 62. Moreover, gas flow through the valve is predictably throttled by the proportional valve, and therefore may be continuously varied based on valve position. Accordingly, the proportional valve is configured such that varying the voltage linearly results in a behavior of the valve position which results in linear behavior of the gas flow to burner 70. See FIG. 5. Although a single potentiometer, voltage regulator, valve, and burner are shown in FIG. 3, any suitable number of these components may be provided.

Figure 4:
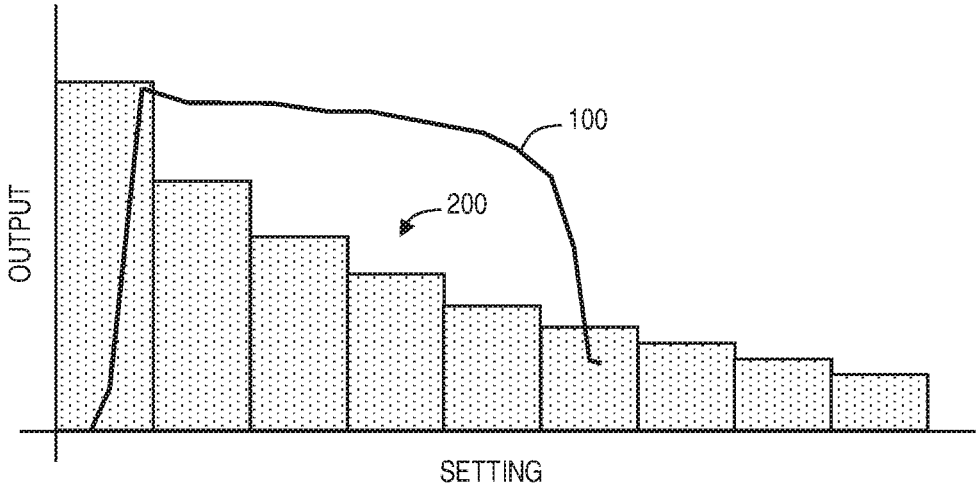
FIG. 4 PRIOR ART
FIG. 4 is a chart depicting the output of two different prior art controls for gas burner systems.
Figure 5:
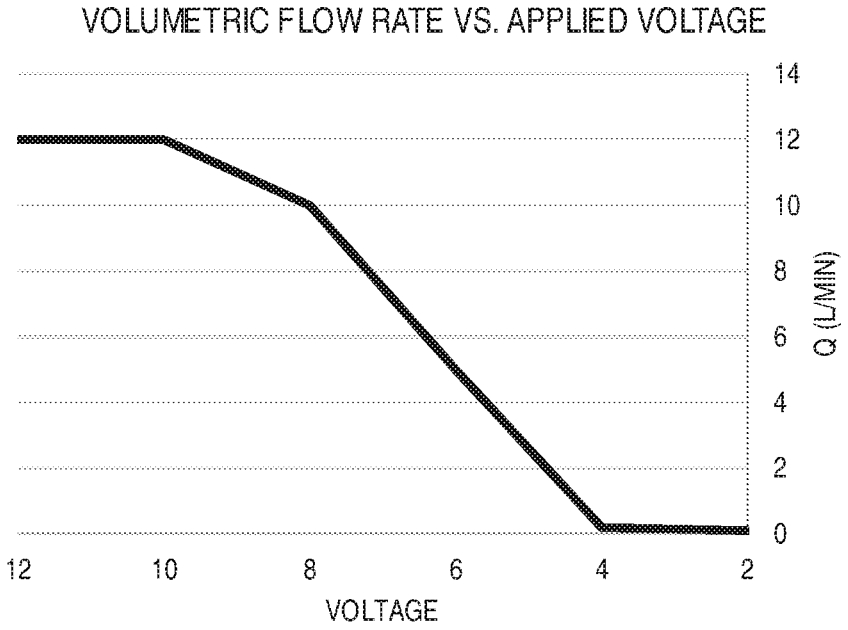
FIG. 5 is a chart depicting the output of an illustrative control system according to the present teachings.

Turning to FIGS. 4 and 5, illustrative effects of systems 12 and 52 are depicted. FIG. 4 is a chart showing the non-linear output of two prior art burner control systems. First, a mechanical control system (e.g., where a knob functions as a mechanical valve actuator) is depicted at curve 100. As shown, the output is non-linear with respect to the setting of the UI element. Furthermore, predictability of the output based on the position of the UI element is nonintuitive and difficult. Second, a step-valve system is depicted at series 200. Each bar represents a different discrete setting of the UI element (typically a multi-position dial). As shown, the output varies in a discrete and non-linear fashion, as would be expected from the system's design.

In contrast, FIG. 5 depicts an example of the results achievable using an illustrative system according to the present teachings. In this example, the volumetric flow rate varies in a linear fashion over large changes in the solenoid control voltage. Accordingly, the system may be configured to utilize a range of voltages (e.g., 4V-8V) that provides a predictable, consistent, and linear flow response.

C. Illustrative Method

Figure 6:
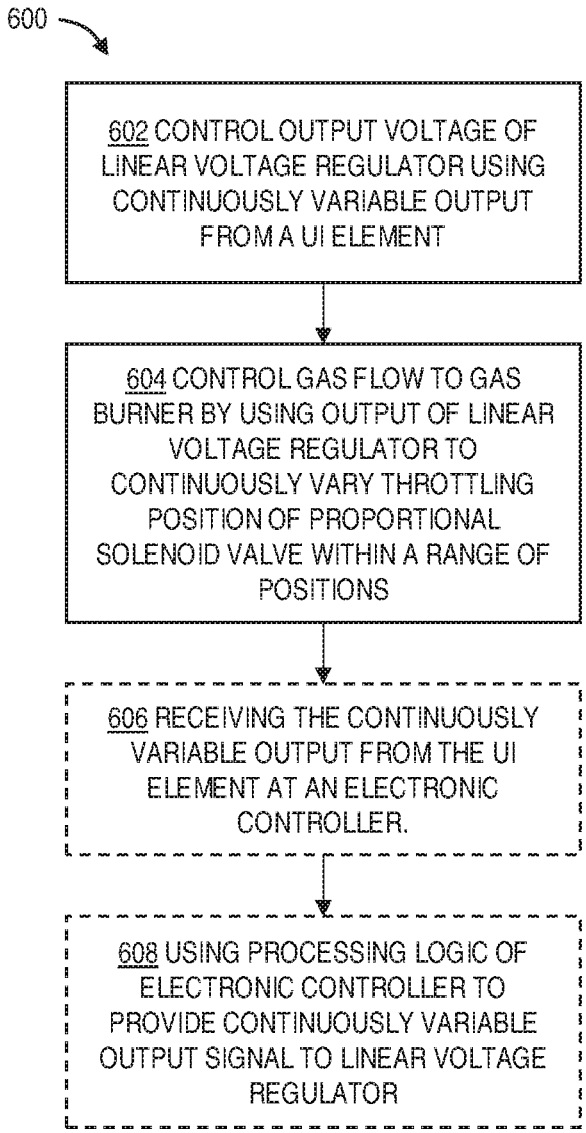
FIG. 6 is a flow chart depicting steps of an illustrative method for controlling a burner of a gas cooktop in accordance with aspects of the present disclosure.

This section describes steps of an illustrative method 600 for controlling one or more burners of a gas cooktop; see FIG. 6. Aspects of gas control systems described above may be utilized in the method steps described below. Where appropriate, reference may be made to components and systems that may be used in carrying out each step. These references are for illustration, and are not intended to limit the possible ways of carrying out any particular step of the method.

FIG. 6 is a flowchart illustrating steps performed in an illustrative method, and may not recite the complete process or all steps of the method. Although various steps of method 600 are described below and depicted in FIG. 6, the steps need not necessarily all be performed, and in some cases may be performed simultaneously or in a different order than the order shown.

Step 602 includes controlling an output voltage of a linear voltage regulator using a continuously variable output from a user interface (UI) element. The UI element may include a rotatable mechanical knob. In some examples, the UI element is coupled to a potentiometer having a variable resistance, and the output voltage of the linear voltage regulator is controlled based on the variable resistance.

Step 604 includes controlling a gas flow to a gas burner from a supply of combustible gas by using the output of the linear voltage regulator to continuously vary a throttling position of a proportional solenoid valve within a range of positions. The gas flow to the gas burner has a linear relationship with the output voltage of the linear voltage regulator.

Optionally, step 606 includes receiving the continuously variable output from the UI element at an electronic controller. In this example, the UI element may include a capacitive touch control. In some examples, the UI element may include a mobile digital device in wireless communication with the electronic controller.

When step 606 is performed, step 608 includes using processing logic of the electronic controller to provide a continuously variable output signal to the linear voltage regulator, such that the output voltage of the linear voltage regulator is controlled by the output signal of the controller.

D. Illustrative Combinations and Additional Examples

This section describes additional aspects and features of the control systems disclosed herein, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A gas cooktop comprising:

a gas burner;

a throttle valve controlling a gas flow to the gas burner from a supply of combustible gas, wherein the throttle valve comprises a proportional solenoid valve having a continuously variable position; and a linear voltage regulator having a continuously variable output voltage configured to be controllable by a user interface (UI) element;

wherein the output voltage of the linear voltage regulator is coupled to a solenoid of the throttle valve and configured to control the continuously variable position of the throttle valve, such that the gas flow to the gas burner has a linear relationship with the output voltage of the linear voltage regulator.

A1. The gas cooktop of A0, wherein the UI element comprises a rotatable mechanical knob.

A2. The gas cooktop of A0 or A1, wherein the UI element is coupled to a potentiometer having a variable resistance, and the output voltage of the linear voltage regulator is controlled based on the variable resistance.

A3. The gas cooktop of any one of paragraphs A0 through A2, further comprising an electronic controller having processing logic; wherein UI element is configured to provide a continuously variable input to the controller, and the processing logic is configured to provide a continuously variable output signal to the linear voltage regulator, such that the output voltage of the linear voltage regulator is controlled by the output signal of the controller.

A4. The gas cooktop of A3, wherein the UI element comprises a capacitive touch control.

A5. The gas cooktop of A3, wherein the UI element comprises a mobile digital device in wireless communication with the electronic controller.

A6. The gas cooktop of A3, wherein the linear voltage regulator comprises a power MOSFET.

A7. The gas cooktop of any one of paragraphs A0 through A6, wherein the supply of combustible gas comprises a propane tank.

A8. The gas cooktop of any one of paragraphs A0 through A6, wherein the supply of combustible gas comprises a natural gas line.

B0. A gas cooktop comprising:

a gas burner;

a proportional solenoid valve controlling a gas flow to the gas burner from a supply of combustible gas, wherein the proportional solenoid valve has a continuously variable range of positions;

a user interface (UI) element associated with the proportional solenoid valve; and a linear voltage regulator having a continuously variable output voltage configured to be controllable by the UI element;

wherein the output voltage of the linear voltage regulator is coupled to a solenoid of the proportional solenoid valve, such that the gas flow to the gas burner has a linear relationship with the output voltage of the linear voltage regulator.

B1. The gas cooktop of B0, wherein the UI element comprises a rotatable mechanical knob.

B2. The gas cooktop of B0 or B1, wherein the UI element is coupled to a potentiometer having a variable resistance, and the output voltage of the linear voltage regulator is controlled based on the variable resistance.

B3. The gas cooktop of any one of paragraphs B0 through B2, further comprising an electronic controller having processing logic; wherein UI element is configured to provide a continuously variable input to the controller, and the processing logic is configured to provide a continuously variable output signal to the linear voltage regulator, such that the output voltage of the linear voltage regulator is controlled by the output signal of the controller.

B4. The gas cooktop of B3, wherein the UI element comprises a capacitive touch control.

B5. The gas cooktop of B3, wherein the UI element comprises a mobile digital device in wireless communication with the electronic controller.

B6. The gas cooktop of B3, wherein the linear voltage regulator comprises a power MOSFET.

B7. The gas cooktop of any one of paragraphs B0 through B6, wherein the supply of combustible gas comprises a propane tank.

B8. The gas cooktop of any one of paragraphs B0 through B6, wherein the supply of combustible gas comprises a natural gas line.

C0. A method for controlling a burner of a gas cooktop, the method comprising:

controlling the output voltage of a linear voltage regulator using a continuously variable output from a user interface (UI) element; and controlling a gas flow to a gas burner from a supply of combustible gas by using the output of the linear voltage regulator to continuously vary a throttling position of a proportional solenoid valve within a range of positions;

wherein the gas flow to the gas burner has a linear relationship with the output voltage of the linear voltage regulator.

C1. The method of C0, wherein the UI element comprises a rotatable mechanical knob.

C2. The method of C0 or C1, wherein the UI element is coupled to a potentiometer having a variable resistance, and the output voltage of the linear voltage regulator is controlled based on the variable resistance.

C3. The method of any one of paragraphs C0 through C2, further comprising:

receiving the continuously variable output from the user interface (UI) element at an electronic controller; and using processing logic of the electronic controller to provide a continuously variable output signal to the linear voltage regulator, such that the output voltage of the linear voltage regulator is controlled by the output signal of the controller.

C4. The method of C3, wherein the UI element comprises a capacitive touch control.

C5. The method of C3, wherein the UI element comprises a mobile digital device in wireless communication with the electronic controller.

C6. The gas cooktop of C3, wherein the linear voltage regulator comprises a power MOSFET.

C7. The gas cooktop of any one of paragraphs C0 through C6, wherein the supply of combustible gas comprises a propane tank.

C8. The gas cooktop of any one of paragraphs C0 through C6, wherein the supply of combustible gas comprises a natural gas line.

Advantages, Features, and Benefits

The different embodiments and examples of the control systems described herein provide several advantages over known solutions for controlling gas flow to (and therefore the flame and heat settings of) a gas cooktop. For example, illustrative embodiments and examples described herein allow a more precise, consistent, repeatable, and/or responsive control of gas flow to a burner, and therefore of heat to a cooktop.

Additionally, and among other benefits, illustrative embodiments and examples described herein allow a more intuitive relationship between the user interface and the actual burner output.

Additionally, and among other benefits, illustrative embodiments and examples described herein allow remote and/or wireless control of the burner.

Additionally, and among other benefits, illustrative embodiments and examples described herein facilitate repeatability of the amount of heat being applied to a cooking surface.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A gas cooktop comprising:

a gas burner;

a throttle valve controlling a gas flow to the gas burner from a supply of combustible gas, wherein the throttle valve comprises a proportional solenoid valve having a continuously variable position;

a linear voltage regulator having a continuously variable output voltage configured to be controllable by a user interface (UI) element; and an electronic controller having processing logic, wherein the output voltage of the linear voltage regulator is coupled to a solenoid of the throttle valve and configured to control the continuously variable position of the throttle valve, such that the gas flow to the gas burner has a linear relationship with the output voltage of the linear voltage regulator, and the UI element is configured to provide a continuously variable input to the controller, and the processing logic is configured to provide a continuously variable output signal to the linear voltage regulator, such that the output voltage of the linear voltage regulator is controlled by the output signal of the controller.

2. The gas cooktop of claim 1, wherein the UI element comprises a rotatable mechanical knob.

3. The gas cooktop of claim 1, wherein the UI element comprises a capacitive touch control.

4. The gas cooktop of claim 1, wherein the UI element comprises a mobile digital device in wireless communication with the electronic controller.

5. The gas cooktop of claim 1, wherein the supply of combustible gas comprises a propane tank.

6. A gas cooktop comprising:

a gas burner;

a proportional solenoid valve controlling a gas flow to the gas burner from a supply of combustible gas, wherein the proportional solenoid valve has a continuously variable range of positions;

a user interface (UI) element associated with the proportional solenoid valve;

a linear voltage regulator having a continuously variable output voltage configured to be controllable by the UI element; and an electronic controller having processing logic, wherein the output voltage of the linear voltage regulator is coupled to a solenoid of the proportional solenoid valve, such that the gas flow to the gas burner has a linear relationship with the output voltage of the linear voltage regulator, and the UI element is configured to provide a continuously variable input to the controller, and the processing logic is configured to provide a continuously variable output signal to the linear voltage regulator, such that the output voltage of the linear voltage regulator is controlled by the output signal of the controller.

7. The gas cooktop of claim 6, wherein the UI element comprises a rotatable mechanical knob.

8. The gas cooktop of claim 6, wherein the UI element comprises a capacitive touch control.

9. The gas cooktop of claim 6, wherein the UI element comprises a mobile digital device in wireless communication with the electronic controller.

10. The gas cooktop of claim 6, wherein the linear voltage regulator comprises a power MOSFET.

11. A method for controlling a burner of a gas cooktop, the method comprising:

controlling an output voltage of a linear voltage regulator using a continuously variable output from a user interface (UI) element;

controlling a gas flow to a gas burner from a supply of combustible gas by using the output of the linear voltage regulator to continuously vary a throttling position of a proportional solenoid valve within a range of positions;

receiving the continuously variable output from the user interface (UI) element at an electronic controller; and using processing logic of the electronic controller to provide a continuously variable output signal to the linear voltage regulator, such that the output voltage of the linear voltage regulator is controlled by the output signal of the controller, wherein the gas flow to the gas burner has a linear relationship with the output voltage of the linear voltage regulator.

12. The method of claim 11, wherein the UI element comprises a rotatable mechanical knob.

13. The method of claim 11, wherein the UI element comprises a capacitive touch control.

14. The method of claim 11, wherein the UI element comprises a mobile digital device in wireless communication with the electronic controller.

15. The method of claim 11, wherein the UI element comprises a graphical user interface on a display.

16. The method of claim 11, wherein the UI element comprises a voice interface capable of speech recognition.

17. The gas cooktop of claim 6, wherein the UI element comprises a graphical user interface on a display.

18. The gas cooktop of claim 6, wherein the UI element comprises a voice interface capable of speech recognition.

19. The gas cooktop of claim 1, wherein the UI element comprises a graphical user interface on a display.

20. The gas cooktop of claim 1, wherein the UI element comprises a voice interface capable of speech recognition.

* * * * *